US006260325B1

(12) United States Patent
Wendt et al.

(10) Patent No.: US 6,260,325 B1
(45) Date of Patent: Jul. 17, 2001

(54) SUSPENDED CONCEALED GRID ACCESSIBLE CEILING SYSTEM

(75) Inventors: Alan C. Wendt, Barrington; David R. Stover, Evanston, both of IL (US); Gerald L. Koski, Parma, OH (US)

(73) Assignee: USG Interiors, Inc., Chicago, IL (US)

( * ) Notice: Subject to any disclaimer, the term of this patent is extended or adjusted under 35 U.S.C. 154(b) by 0 days.

(21) Appl. No.: 09/270,880

(22) Filed: Mar. 17, 1999

(51) Int. Cl.[7] ..... E04B 9/06; E04B 9/18

(52) U.S. Cl. ..... 52/506.07; 52/489.2; 52/506.09; 52/715; 52/656.9; 52/762; 52/778; 52/781

(58) Field of Search ..... 52/506.07, 506.09, 52/489.1, 489.2, 656.9, 715, 716.4, 716.7, 718.04, 762, 779, 145, 39, 222; 248/339, 340, 228.1, 230.7, 228.7, 231.81, 316.7, 74.2

(56) References Cited

U.S. PATENT DOCUMENTS

| | | | | |
|---|---|---|---|---|
| 2,895,180 | | 7/1959 | Byssing . | |
| 3,175,656 | | 3/1965 | Schoenfeld . | |
| 3,934,387 | * | 1/1976 | Moeller | 52/760 |
| 4,279,110 | | 7/1981 | Palazzolo et al. . | |
| 4,471,593 | * | 9/1984 | Ragland | 52/489 |
| 4,696,141 | | 9/1987 | Nassof . | |
| 4,760,677 | | 8/1988 | Nassof . | |
| 4,922,677 | | 5/1990 | Fridh et al. . | |
| 4,991,373 | * | 2/1991 | Shaub | 52/715 |
| 5,024,034 | * | 6/1991 | Gailey | 52/484 |
| 5,311,719 | | 5/1994 | Jahn . | |
| 5,761,869 | * | 6/1998 | Tinen et al. | 52/506.07 |
| 5,896,724 | * | 4/1999 | Tofts | 52/739.1 |
| 6,047,511 | * | 4/2000 | Lehane et al. | 52/506.07 |
| 6,108,994 | * | 8/2000 | Bodine | 52/506.07 |

FOREIGN PATENT DOCUMENTS

| | | |
|---|---|---|
| 0 211 172 | 2/1987 | (EP) . |
| 0 393 000 | 10/1990 | (EP) . |
| 0 344 164 | 12/1994 | (EP) . |
| 810740 | 3/1959 | (GB) . |
| 833307 | 4/1960 | (GB) . |
| 857773 | 1/1961 | (GB) . |
| 1 277 923 | 6/1972 | (GB) . |
| 2 163 787 | 3/1986 | (GB) . |
| 2 200 151 | 7/1988 | (GB) . |

OTHER PUBLICATIONS

OWA Odenwald Faserplattenwerk GmbH, OWAtecta—Metalldecken Systeme fur Neuverlegung Renovierung und Sanierung (System 2000), Nov., 1995, 4 pages.

* cited by examiner

*Primary Examiner*—Carl D. Friedman
*Assistant Examiner*—Yvonne M. Horton
(74) *Attorney, Agent, or Firm*—Pearne & Gordon LLP

(57) ABSTRACT

A suspended ceiling system in which the grid runners are largely concealed by the panels to produce a distinctive high quality appearance. In various illustrated embodiments, the visual effect is produced as a result of the panels being separated by a relatively narrow gap in two perpendicular directions or by a narrow gap in one direction and essentially no gap in the perpendicular direction, and the grid being recessed above the main face of the panels. The panels are accurately positioned on the grid by metal clips, normally permanently attached to the panels, which engage upstanding flange portions of the grid runners. The accurate positioning afforded by the clips assures that visually distracting variations in the size of the narrow gaps are avoided. The clips can also serve to avoid accidental dislodging of the panels.

16 Claims, 6 Drawing Sheets

FIG. 1
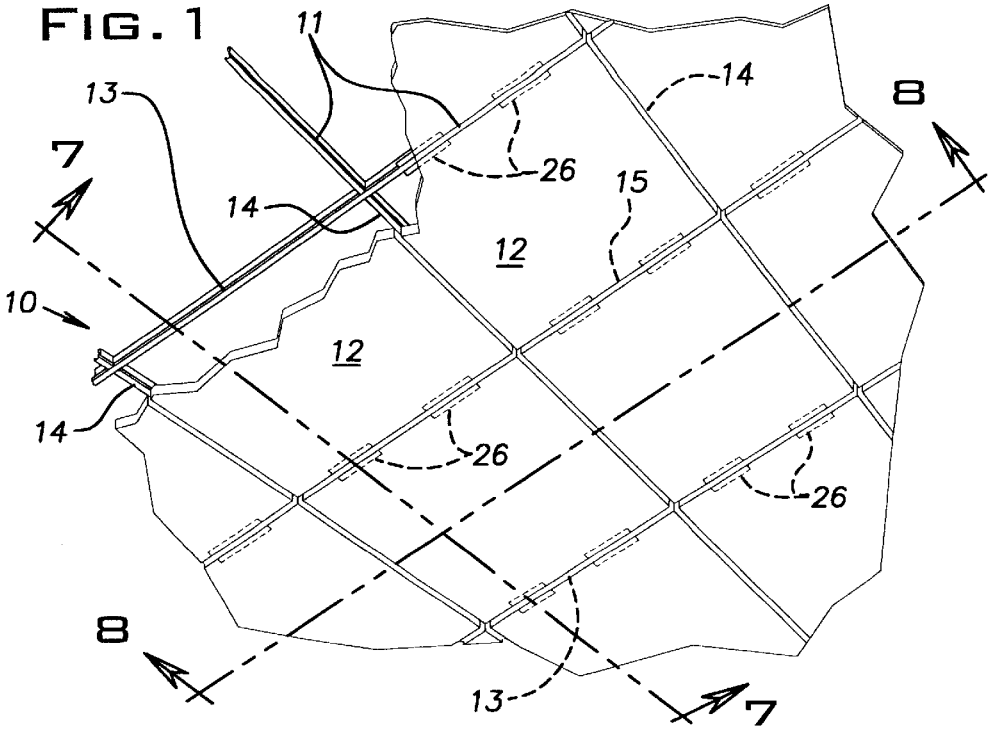
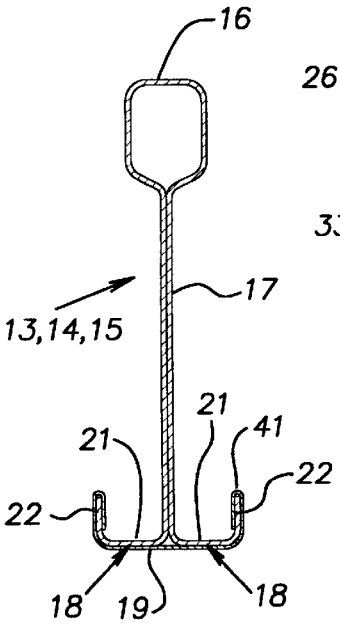
FIG. 2
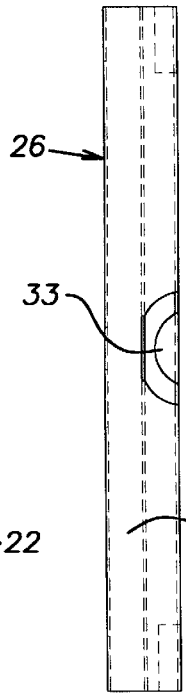
FIG. 3
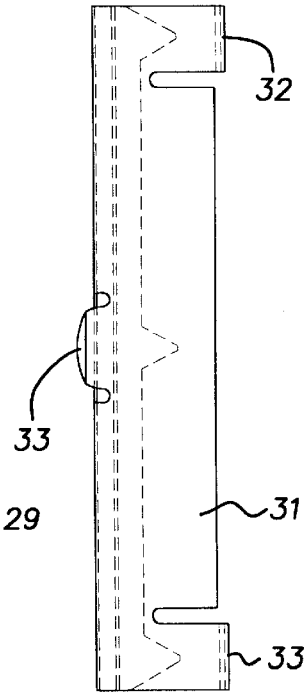
FIG. 4
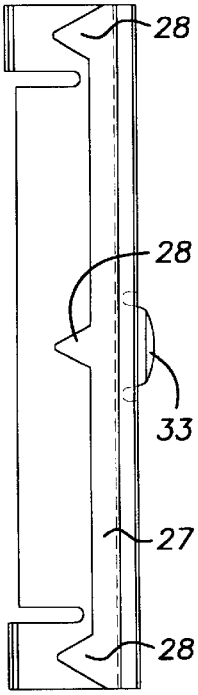
FIG. 5
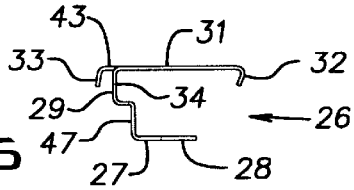
FIG. 6

SUSPENDED CONCEALED GRID ACCESSIBLE CEILING SYSTEM

BACKGROUND OF THE INVENTION

The invention relates to suspended ceiling constructions and, in particular, to a type of suspended ceiling having a panel supporting grid and associated panels arranged such that the grid is largely concealed by the panels.

PRIOR ART

Various systems have been proposed to provide a concealed grid suspends an array of rectangular removable ceiling panels. In general, such prior art systems have had one or more disadvantages and there remains the need for a versatile system that can be readily manufactured and installed and which provides a high quality appearance. Commonly, in these systems, the panels are formed with intricate edge details which can be difficult to manufacture, are relatively fragile, and are prone to become damaged with even moderate mishandling. Moreover, these prior art panels are often of limited stability and can be dislodged and even dropped when subjected to an accidental blow.

SUMMARY OF THE INVENTION

The invention provides a suspended ceiling construction with an improved appearance that is derived from a suspension grid that is largely concealed by the ceiling panels. More specifically, the visual effect of the ceiling is dramatically improved by the diminished exposure and recessing of the grid between the panels. The construction utilizes a combination of a metal clip attached to a panel and a grid member with an upstanding flange portion that is engaged by the clip. The clip accurately and positively locates its associated panel relative to the grid and prevents it from accidentally shifting horizontally out of its proper location. The precise locating action obtained by the clip and flange combination permits the panels to be constructed in such a way that only a relatively small aesthetically pleasing gap exists between adjacent panels. Since the panels are accurately located, there is no noticeable variation in the gaps between panels.

The invention can be practiced in a variety of grid and panel designs providing for either upward or downward access. In the preferred embodiment, all of the grid members have the same "W" flange configuration so that square panels can be assembled in any of four positions, i.e. turned 360° about a vertical axis making them readily adaptable to all edge conditions. The uniform grid geometry, in addition, simplifies the mounting of accessories such as lights and air diffusers.

BRIEF DESCRIPTION OF THE DRAWINGS

FIG. 1 is a somewhat diagrammatic fragmentary perspective upward view of a suspended ceiling system constructed in accordance with the invention;

FIG. 2 is a cross-sectional view of a grid tee member used in the grid of the ceiling system of FIG. 1;

FIG. 3 is a side view of one form of a ceiling panel clip of the invention;

FIG. 4 is a top view of the panel clip;

FIG. 5 is a bottom view of the panel clip;

FIG. 6 is an end view of the panel clip;

DESCRIPTION OF THE PREFERRED EMBODIMENTS

Figure 7:
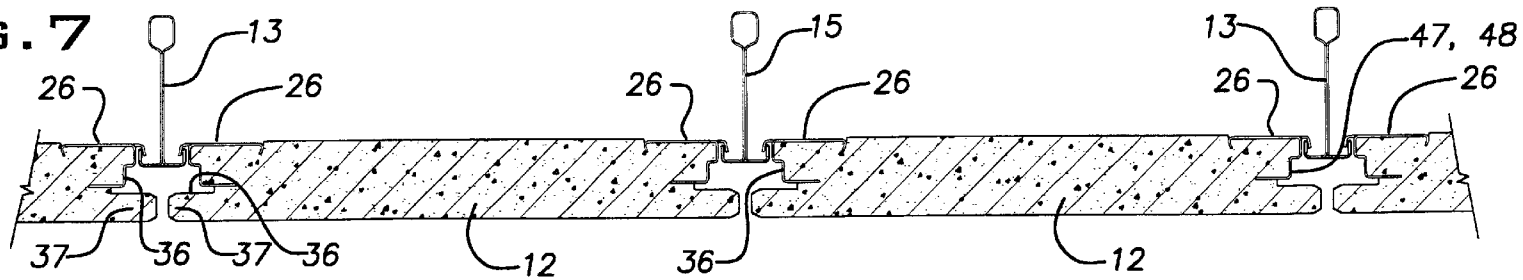
FIG. 7 is a cross-sectional view of the ceiling system taken in the plane indicated at 7—7 in FIG. 1.

Referring now to FIGS. 1 through 9, a suspended ceiling system 10 embodying a first version of the invention, comprises a suspension grid 11 and removable panels 12. While the illustrated grid 11 forms square openings and the panels 12 are square, the invention is applicable to rectangular patterns. For convenience, when the term "rectangular" is used herein, it will be understood that such term includes square shapes. In a conventional manner, the grid 11 includes main runners or tees 13 of extended length and cross runners or tees 14, 15 of limited length. Certain cross runners 14 are nominally four foot long and certain other cross runners 15 are nominally two foot long. The main runner and cross runner patterns of the grid constructions of other embodiments discussed below can be the same as described here in connection with FIGS. 1 through 9. Alternatively, the invention can be practiced with other known grid patterns such as a basket weave pattern.

In the first embodiment or version of the invention shown in FIGS. 1 through 9, the main and cross runners 13, 14 and 15, respectively, have the same general configuration which is depicted on an enlarged scale in FIG. 2. In this and in the other embodiments disclosed herein, the main runner 13, as is conventional, can be taller and/or be constructed of heavy gauge material for suitable load capacity. The runners 13, 14 and 15 are in the general form of an inverted tee and, with reference to their flange area, can be described as having a W-shaped configuration. These runners or tees 13, 14 and 15, have a hollow upper stiffening bulb 16, a vertical double web 17, and oppositely extending flanges 18. Preferably, the tee is formed, typically by a rolling process known in the art, so that the bulb 16, web 17 and flanges 18 are all integral and the web has a double wall. As illustrated, the flanges 18 include a covering or cap 19 of sheet metal rolled or otherwise bent onto the flanges 18. The cap 19 can have its exterior surface painted a suitable color or be otherwise finished with a suitable appearance. The opposed flanges 18 are symmetrical about a central plane between the members of the web 17. The flanges 18 have a horizontal portion 21 proximal to the web 17 and a vertical upstanding portion 22 distal from the web. The width of the tee 13, 14 and 15 measured horizontally from outside surface to outside surface is relatively narrow as compared to a standard flange width of say 15/16 of an inch. For instance, in the preferred embodiment, the flange width can be nominally one-half inch. The web 17 is provided with holes for suspending it by suitable wires as is customary. The ends of the runners or tees 13, 14 have suitable connectors (not shown) for coupling to similar tees end-to-end or to receiving holes in transverse tees as is conventional.

A clip 26, preferably stamped from suitable steel stock, is illustrated in detail in FIGS. 3 through 6. The clip 26, when viewed from an end as in FIG. 6, is generally C-shaped or channel shaped. A bottom flange 27 of the clip or bracket 26 includes a pair of barbs 28 adjacent its ends and one at its center, each pointed away from a stepped web 29. The web 29 is stepped with an offset 47 that conforms generally to the edge profile of the panels 12. A top flange 31 of the clip 26 has a pair of grips 32 adjacent its ends that are turned downwardly. The web 29 has a generally vertically depending tab member 33 at its mid-length. The tab or hook 33 is stamped out of the plane of the adjacent web material so that there is a limited horizontal distance determined by a bight 43 between the plane of an upper part 34 of the web 29 and the plane of the tab 33.

Figure 8:
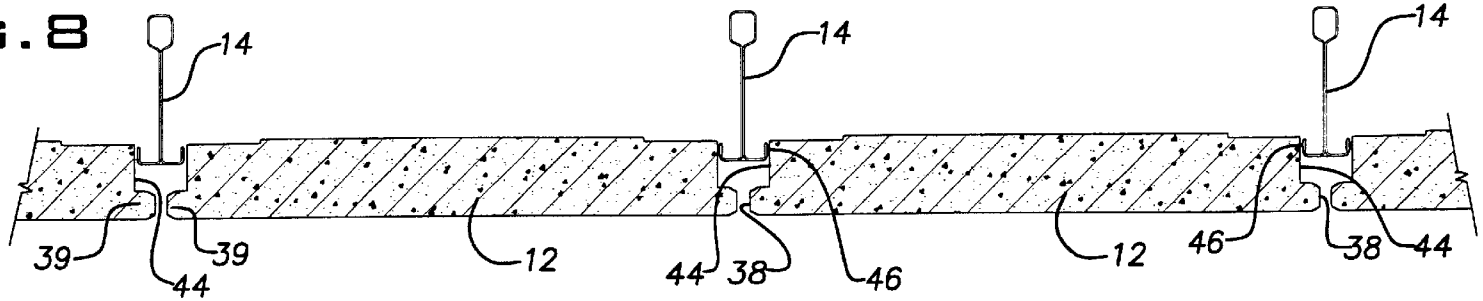
FIG. 8 is a cross-sectional view of the ceiling system taken in the plane indicated at 8—8 in FIG. 1.
Figure 9:
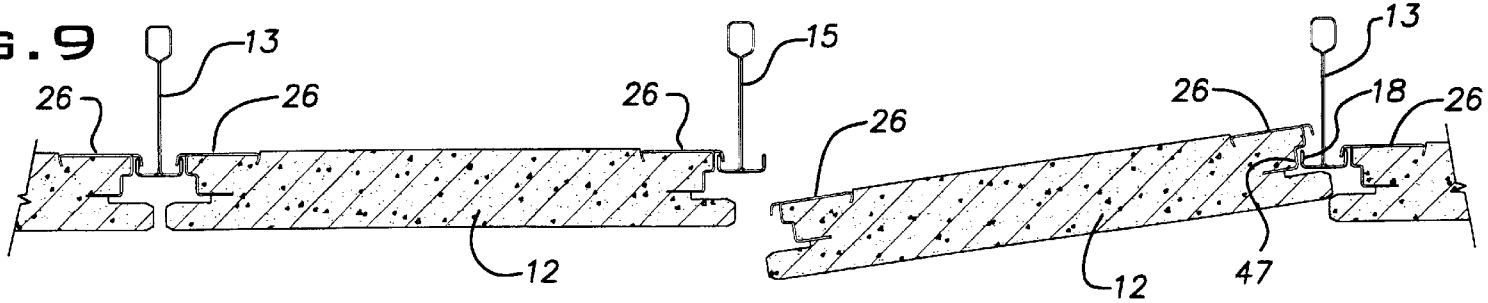
FIG. 9 is a view similar to FIG. 7 showing how access to the space above the ceiling system is achieved with downward panel removal.

Identical clips 26 are attached to edges of a panel 12 as shown in FIGS. 7–9. In the illustrated arrangement, as suggested in FIG. 1, where the clips are shown in phantom, there are two clips provided on each of a pair of opposite edges of a panel 12. The clips 26, preferably installed on panel 12 at the factory where the panel is made, are located adjacent the upper face or back of the panel. The edges 36 of the panel receiving the clips or brackets 26, are rabbeted with a shape that is complimentary to the cross-section of the clips. The panel 12 is ordinarily formed of a material soft enough to enable the barbs 28 and grips 32 to locally penetrate the body of the panel but strong enough such that the clips 26 are self-retained on the panel normally in a permanent manner. The rabbeted edges 36 include a portion 37 that extends horizontally beyond the bracket or clip 26. Panel edges 38 at 90° from the edges 36 carrying the clips 26 are rabbeted with a relatively plain cross-section (FIG. 8) to leave a projecting lower portion 39.

FIGS. 7 and 8 show the installed condition of the ceiling system 10 in cross-section. The vertical flange portions 22 of the grid runners 13, 15 are received in the bracket space or gap between the web 29 and the tab or hook 33. The weight of a panel 12 is supported by an upper edge 41 of the vertical flange portion 22 received in this space and bearing against the bight 43 between the tab and adjacent part of the clip or bracket 26. The width of this gap is precisely controlled such that there is very limited or no clearance with the vertical flange portion 22 so that the panel 12 is located accurately in horizontal position relative to the grid runners supporting the panel.

Vertical surfaces 44 of the rabbeted edges 38 of the panel 12 are located so that the panels are closely constrained by the outside surface, designated 46, of adjacent grid runners.

It will be understood from the foregoing that the panels 12, when installed, are very accurately located by the vertical flange portions 22 of the grid runners either through the clips 26 or through abutting contact with the surfaces 46. This precise positioning enables the panels to be dimensioned to provide a relatively narrow gap, for example, 1/8", between adjacent panels without the risk of visually noticeable variations in this gap which would otherwise detract from the appearance of the system 10. It will be understood that the panels 12, optionally, can be mounted with the clips 26 on the cross runners 14 such that the panels are rotated 90° about a vertical axis from that illustrated.

FIG. 9 illustrates a panel 12 being removed with downward access. To remove the panel 12, it must be lifted at both edges 36 and then horizontally shifted. This lifting movement releases the hooks or tabs 33 on opposite edges 36 of the panel 12 from engagement with the vertical flange portions 22 on the supporting grid members 13 or 15. While lifted, the panel 12 is shifted horizontally so that the hooks 33 on one side of the panel can drop below the associated vertical flange portion 22. To allow limited horizontal shifting, the cross-sectional profiles of the clip 26 and the panel 12 provides respective recesses or offsets 47, 48 into which the adjacent flange 18 can be received. Once one edge 36 of the panel 12 is lowered below the plane of the adjacent panel it can be shifted in the opposite generally horizontal direction to allow the opposite panel edge to be lowered. The manipulation required to remove a panel 12 is intuitive because of the guiding functions of the vertical flange portions 22. Initially, the panel 12 can only be raised and then be shifted horizontally in either of two opposite directions. A study of FIGS. 7 and 8 reveals that the panels 12 are supported by the grid in a stable manner such that they will not readily fall or otherwise become dislodged if they are accidentally bumped, particularly where only one edge is primarily raised and the panel is only tilted.

As another variant, the panels 12 can be modified at opposite rabbeted edges so that there is essentially no gap between adjacent edges 38 (FIG. 8) that do not carry the associated clips 26. This variant will produce a more linear appearance in the ceiling where only the gaps between the panel edges associated with the clips will be apparent.

Figure 10:
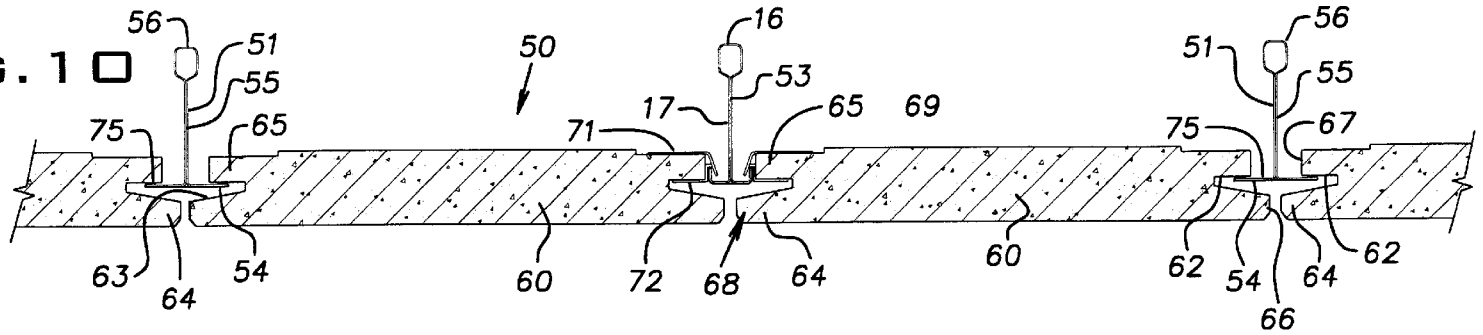
FIG. 10 is a cross-sectional view in a plane similar to that of FIG. 7, of a modified ceiling system.
Figure 11:
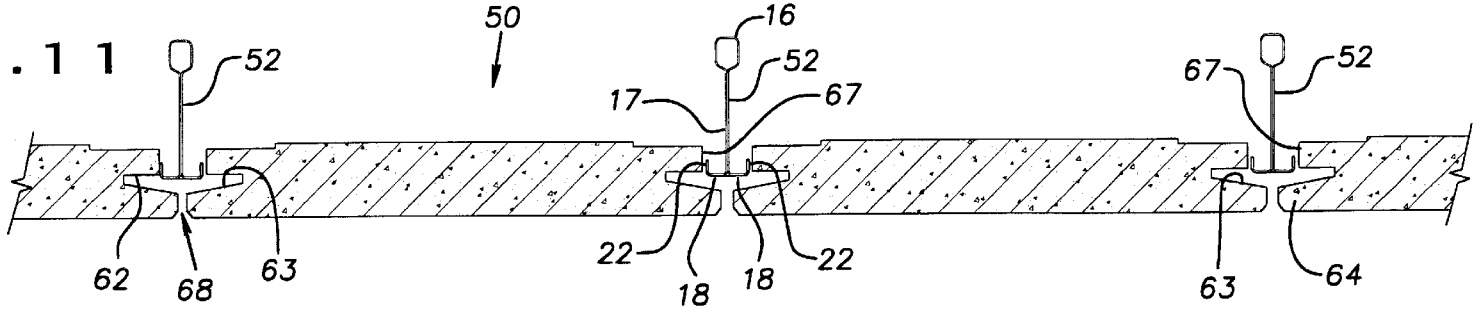
FIG. 11 is a cross-sectional view in a plane similar to that of FIG. 8, of the ceiling system of FIG. 10.

FIGS. 10 and 11 illustrate another form of the invention in which a ceiling system 50 includes conventional main runners or tees 51 and modified cross runners or tees 52, 53. The main runners 51 have the ordinary shape of an inverted tee with horizontal flat flanges 54, a vertical web 55 and a stiffening bulb 56. The modified cross runners 52, 53, in this embodiment, are either 4 foot or 2 foot in nominal length. The cross section of the cross runners 52, 53 is like that described above in connection with the embodiment of FIGS. 1 through 9 and corresponding elements are identified with the same reference numerals in the drawings. In this version, panels 60 have each of their four edges rabbeted with a profile that, in the illustrated case, is the same for each of the four edges. This profile includes a slot 61 with a downward facing horizontal surface 62 and an upward facing sloping surface 63. A lower portion 64 of the panel edge is cantilevered out beyond an upper portion 65 of this edge. Vertical faces 66, 67 of the panel edge lie in different vertical planes with the lower face 66 being horizontally outward beyond the face 67 of the upper portion 65.

A metal clip 69, preferably assembled in pairs on a single panel edge, is similar to the clip 26 disclosed in connection with the embodiment of FIGS. 1 through 9. The clip 69, typically formed as a sheet metal stamping, is generally channel-shaped with upper and lower flanges 71, 72. The clip or bracket 69 is dimensioned so that the flanges 71, 72 tightly grip the upper edge area 65 to permanently retain the clip in precise location on the panel. The clip 69 is preferably installed at the factory where the panel 60 is made. Like the earlier described clip 26, an integral depending hook or tab 73 is formed out of a web 74 of the channel-shaped clip 69. When a panel 60 is installed on the grid, the hook 73 of each of the clips 69 is disposed over the vertical flange portion 22 of an adjacent runner 53. The hook 73 is proportioned to overlie the vertical flange portion 22 of the adjacent runner with a minimum, if any, horizontal clearance. At the panel edge opposite the edge on which the clips 69 are mounted, the panel 60 is supported by contact between the horizontal slot surface 62 and an upper face 75 of the adjacent flange of a main tee or runner 51. In the installed position of the panel 60, edges 68 at 90° to the supporting edges associated with the clips 69 or the main tee flange face 75 are unrestricted in the vertical direction but are each horizontally confined by vertical flange portions 22 of adjacent runners 52.

Figure 12:
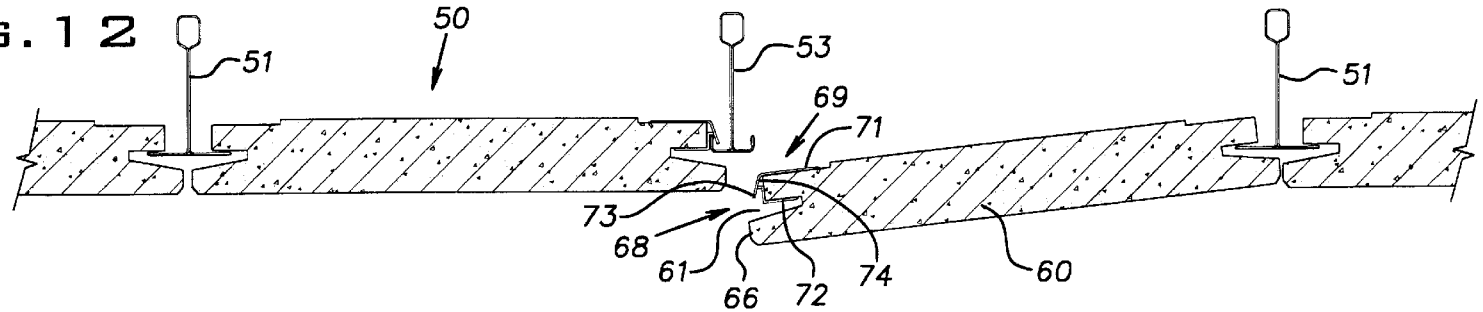
FIG. 12 is a view similar to FIG. 10, showing the removal of a panel with downward access.

FIG. 12 illustrates the panel 60 being removed with downward access. For removal, the panel 60 is first lifted to release the hook or hooks 73 from engagement with the vertical flange portion 22 and then shifted slightly horizontally away from that flange portion. This horizontal movement is accommodated by the horizontal depth of the slot or groove 61. The panel edge with the clips or brackets 69 is then lowered to the position illustrated in FIG. 12. From this position, the panel can be shifted horizontally in the opposite direction to release the opposite edge 68 from engagement with the tee flange 54 and complete removal of the panel 60.

Figure 13:
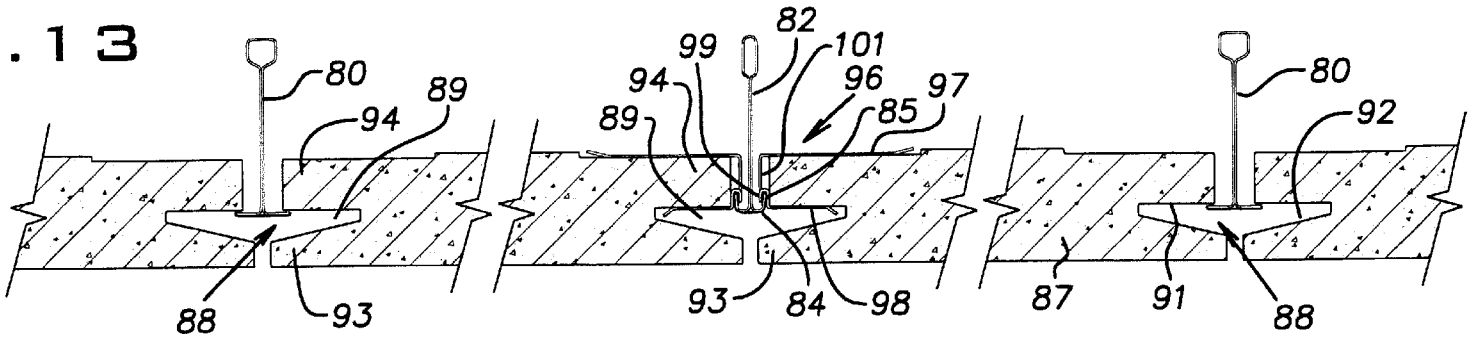
FIG. 13 is a cross-sectional view in a plane similar to that of FIG. 7, showing a third variation of a ceiling system.
Figure 14:
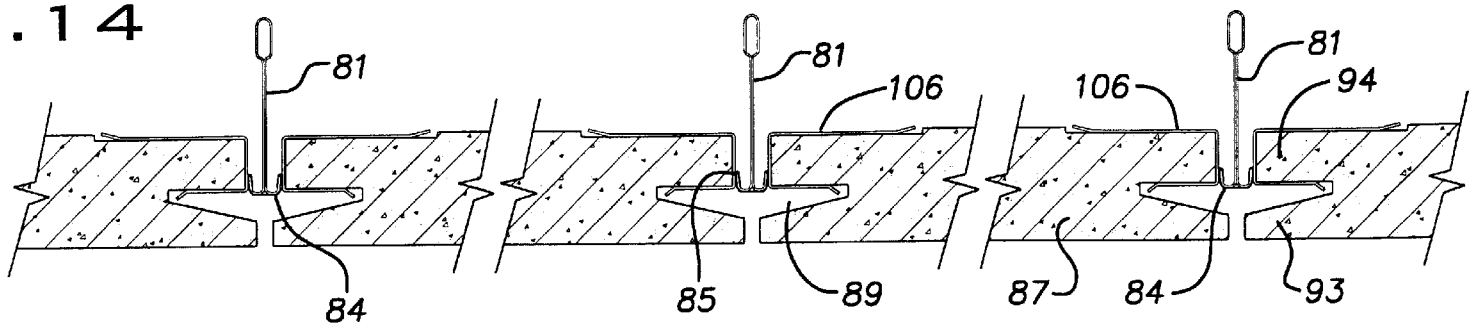
FIG. 14 is a cross-sectional view in a plane similar to that of FIG. 8, of the system of FIG. 13.

FIGS. 13 and 14 illustrate another embodiment of the invention that again provides downward access. This embodiment is similar to that described in FIGS. 10 through 12. FIG. 13 is taken in a plane transverse to the longitudinal direction of main tees 80 and 2 foot cross tees 82. FIG. 14 is taken in a plane parallel to the main tees and transversely through 4 foot cross tees 81. The illustrated main tees 80 are of conventional construction while the cross tees 81 and 82 are characterized by a W-shaped flange construction similar to that disclosed in the other embodiments and particularly at FIG. 2. "W" flanges 84 are relatively narrow in the horizontal direction and include vertical portions 85. More specifically, the width of the W flanges 84 is somewhat narrower than that disclosed in FIG. 2. Panels 87 are similar to the earlier described panels 12 and. 60. Edges 88 of the panels 87 have slots 89 forming horizontal downwardly facing surfaces 91 and sloping upwardly facing surfaces 92. All of the edges 88 of the panels 87 are identical. The panel 87 is supported on the grid in a manner similar to the arrangement disclosed in FIGS. 10–12. A lower portion 93 of the edge is cantilevered horizontally outward beyond an upper portion 94.

One or more channel shaped clips 96 is permanently attached to one edge 88 of the panel 87 at the factory. The channel 96 grips the upper part 94 of the panel edge between its horizontal flanges 97, 98. The clip 96 has a depending hook 99 stamped out of the plane of its web 101. The panel edges 88, at 90° to the edges on which the clip 96 is mounted, are reinforced by channel members 106. The reinforcing or stiffening channels 106 are made of steel or other suitable material and embrace the upper edge portion 93 of the respective edges 88. The channels 106 which run along the majority of the length of the related edges 88 resist the tendency of the panel 87 to sag over time along these edges. As shown in FIG. 13, the panel 87 is suspended by the clip 96 at one edge 88 and the slot surface 91 resting on the flange of a main tee 80 at the opposite edge. The hook 99 of the clip 96, like the preceding embodiments, holds the vertical flange portion of the W flange 84 against the clip web 101 to accurately position the panel relative to the grid. The panels 87 in the embodiment of FIGS. 13 and 14 are removable in essentially the same manner as that described with the earlier embodiments.

Figure 15:
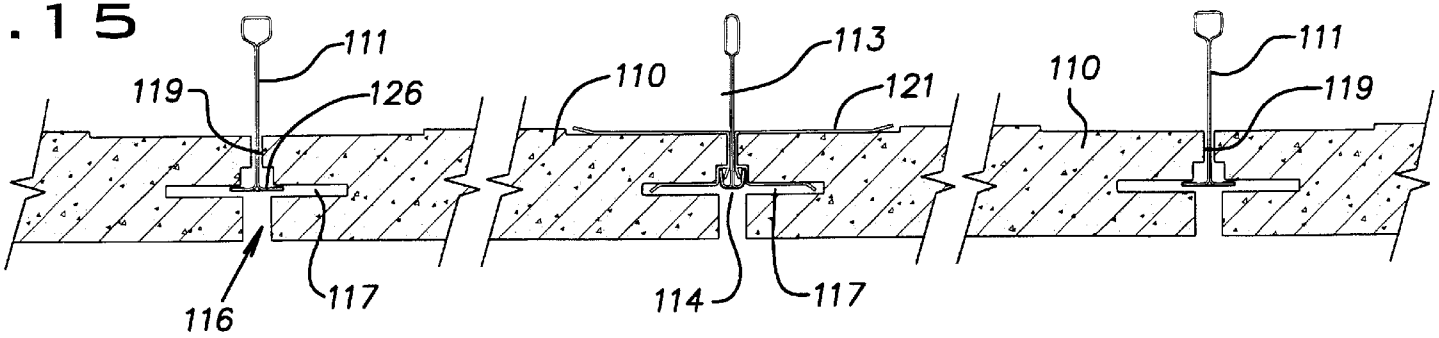
FIG. 15 is a cross-sectional view in a plane similar to that of FIG. 7, showing a fourth variation of a ceiling system.
Figure 16:
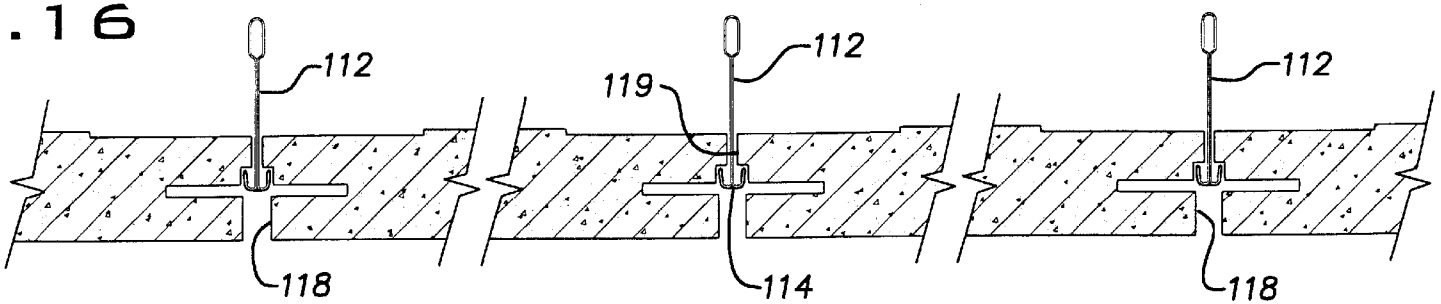
FIG. 16 is a cross-sectional view in a plane similar to that of FIG. 8, showing the system of FIG. 15.
Figure 17:
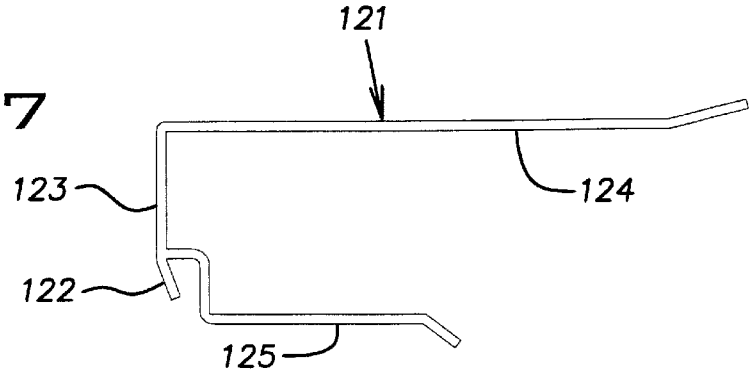
FIG. 17 is an end view of a clip used in the embodiments shown in FIGS. 13 and 15.

Referring now to FIGS. 15–17 there is shown another embodiment of the invention of a suspended ceiling construction which provides "upward access" into the space above the ceiling. With this arrangement a panel 110 is lifted upward from its installed position to gain entry above the ceiling. The ceiling system comprises, in addition to the panels 110, main tees or runners 111 and cross tees 112, 113. The main tees 111 can be conventional in construction. The cross tees or runners 112, 113 have relatively narrow W-shaped flanges 114 like that generally shown in the embodiment of FIGS. 13 and 14 and similar to the other embodiments.

The four edges, designated 116 of each panel 110 preferably have identical profiles. An edge 116 includes a horizontal slot 117 that intercepts a generally vertical recessed face 118 of a rabbet in a lower portion of the edge 116. An upper portion of the edge 116 having a generally vertical face 119 is cantilevered outwardly of the vertical surface 118. The horizontal depth of the rabbet at the edge 116 is proportioned to receive the adjacent half of the W flange 114 of a cross runner with a limited clearance.

One or more channel-shaped clips 121, preferably stamped from sheet steel, shown in FIG. 17, are fixed on one edge 116 of a panel 110. The clip 121 includes a depending hook 122 integrally stamped out of a stepped web 123. Flanges 124, 125 of the clip 121 are arranged to tightly grip an upper face of the panel and an upper surface of the associated slot 117, respectively.

The panel 110 is suspended on the grid runners with the hook 122 engaged with the vertical portion of the adjacent area of a W flange 114 of a cross runner to support part of the weight of a panel. The panel 110 is also supported, at the opposite edge, by the upper surface of a slot 117 bearing on the top face 126 of a flange of a main runner 111. The inter engagement of the hook 122 with the adjacent W flange portion prevents a panel 110 from shifting horizontally so that it is precisely located and resistant to being bumped out of place. The panel 110 can be removed by simply lifting it from its installed position.

Figure 18:
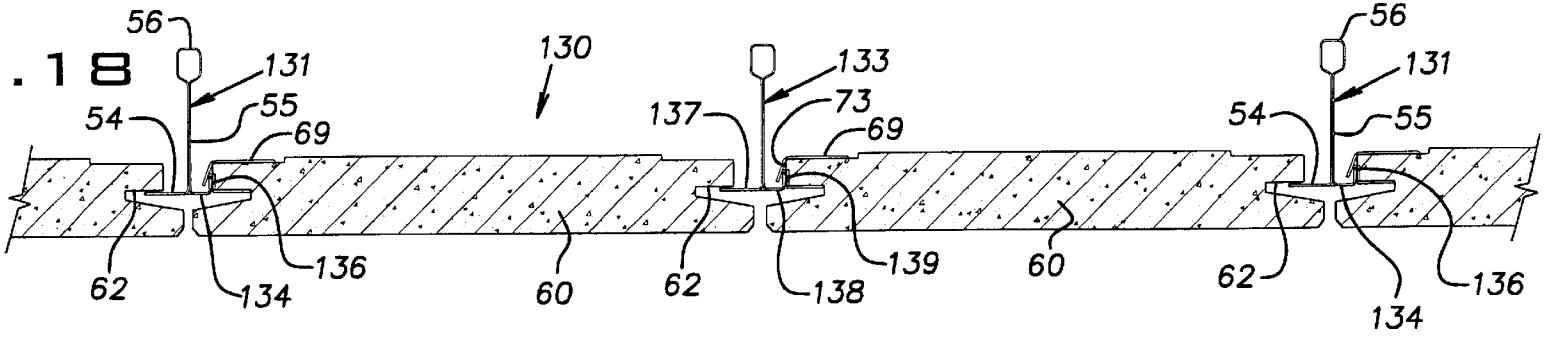
FIG. 18 is a cross-sectional view in a plane similar to that of FIG. 7 of another modified ceiling system.
Figure 19:
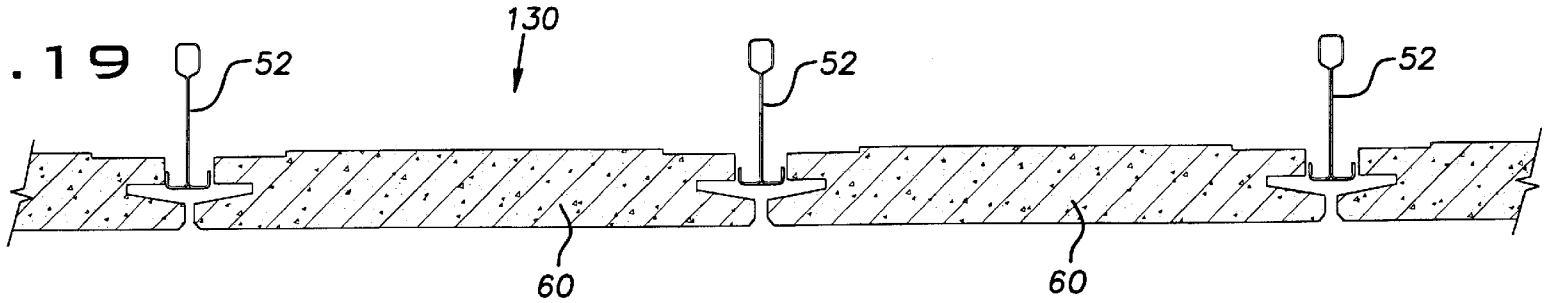
FIG. 19 is a cross-sectional view in a plane similar to that of FIG. 8 of the ceiling system of FIG. 18.

FIGS. 18 and 19 illustrate still another form of the invention in which a ceiling system 130 includes main runners or tees 131 and cross runners or tees 52, 133. The system 130 is similar to that disclosed in FIGS. 10 and 11 as well as FIGS. 1 through 9 and corresponding elements are identified with the same reference numerals. The main runners 131 have the shape of an inverted asymmetrical tee with a horizontal flat flange 54, an angular flange 134, a vertical web 55, and a stiffening bulb 56. The flange 134 includes a vertical portion 136. The cross runners 133 have an asymmetrical profile like the main runners 131 which includes a flat flange 137 and an angular flange 138 with a vertical portion 139. The cross runners 52, 133, in this embodiment, are 4 foot and 2 foot in nominal length, respectively.

Figure 20:
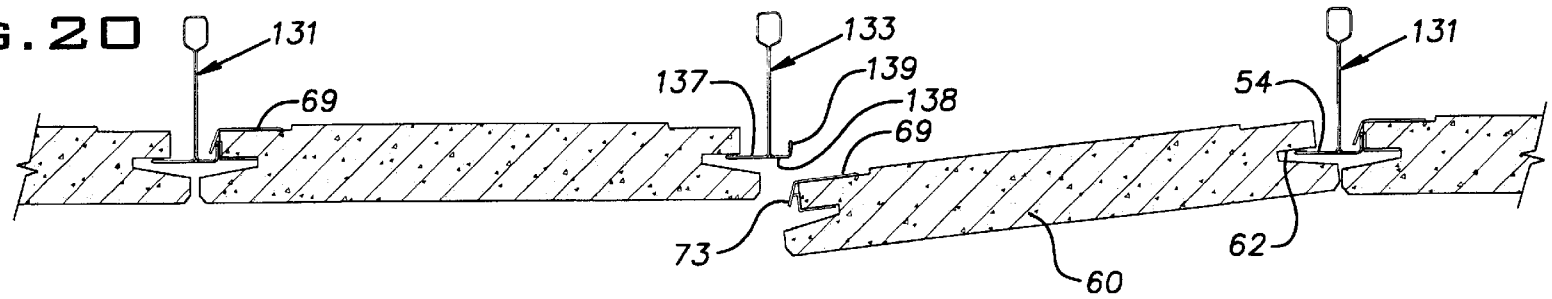
FIG. 20 is a view similar to FIG. 18 showing the removal of a panel with downward access.

The panels 60 and clips 69 are like that of the embodiment of FIGS. 10 and 11. The hook 73 is proportioned to overlie the vertical flange portion 136, 139 of the adjacent runner 131, 133 with a minimum, if any, horizontal clearance. At the panel edge opposite the edge on which the clips 69 are mounted, the panel 60 is supported by contact between the horizontal slot surface 62 and the upper face of the adjacent flange 54 of a main tee or runner 131, or an upper face of the flange 137 of a cross runner 133. FIG. 20 illustrates the panel 60 being removed with downward access in the manner described above in connection with FIG. 12.

While the invention has been shown and described with respect to particular embodiments thereof, this is for the purpose of illustration rather than limitation, and other variations and modifications of the specific embodiments herein shown and described will be apparent to those skilled in the art all within the intended spirit and scope of the invention. Accordingly, the patent is not to be limited in scope and effect to the specific embodiments herein shown and described nor in any other way that is inconsistent with the extent to which the progress in the art has been advanced by the invention.

What is claimed is:

1. A suspended ceiling system comprising grid runners and rectangular panels supported on the grid runners, the grid runners being arranged in a repeating pattern with nominal center-to-center dimensions and to frame a plurality of rectangular areas, the panels being configured to substantially close the rectangular areas, at least some of the grid runners having a cross-section in the general configuration of an inverted tee with a lower flange including a laterally outward portion extending generally vertically upwardly, the panels each having at least one clip element fixed thereto, the clip element having a downwardly extending hook portion interengaging an associated vertically upwardly extending flange portion of an adjacent grid runner, the inter engagement of the hook portion with the vertically upwardly extending flange portion closely horizontally locating the panel relative to said adjacent grid runner whereby the panels are adapted to be sized relative to the center-to-center dimension to form relatively narrow gaps between panels without relatively large variation in gaps between various adjacent panels.

2. A ceiling system as set forth in claim 1, wherein said clip element supports a portion of the weight of the panel.

3. A ceiling system as set forth in claim 1, wherein said panels have generally flat main faces, said grid runners, clip elements, and panels being proportioned to support said flat faces below said grid runners.

4. A ceiling system as set forth in claim 1, wherein said clip elements are formed of metal.

5. A ceiling system as set forth in claim 4, wherein said clip elements are sheet steel stampings.

6. A ceiling system as set forth in claim 1, wherein said panels are rabbeted at their edges to form lower cantilevered portions, said cantilevered portions underlying adjacent grid members.

7. A ceiling system as set forth in claim 6, wherein said panels are proportioned such that the cantilevered portions of adjacent panels form a narrow gap that is substantially less than the width of a grid runner disposed between said adjacent panels.

8. A ceiling system as set forth in claim 6, wherein said panels are rabbeted on two opposite edges with proportions that allow such edges to fit with adjacent panel edges with essentially no gap therebetween.

9. A ceiling system as set forth in claim 1, wherein said vertically upwardly extending flange portions, clip elements and profile of the edges of said panels are configured to require at least one panel edge to be lifted to permit the panel to be displaced from the grid.

10. A ceiling system as set forth in claim 9, wherein said vertically upwardly extending flange portions, clip elements and profile of the edges of said panels are configured to require the panel after being lifted to be shifted horizontally to permit the panel to be displaced from the grid.

11. A ceiling system as set forth in claim 1, wherein all of said grid runners have substantially identical lower flanges.

12. A ceiling system as set forth in claim 1, wherein the grid runners engaged by the clips have asymmetrical profiles with one flange extending horizontally and an opposed flange extending horizontally to said generally vertically upwardly extending portion.

13. A suspended ceiling system comprising grid runners and rectangular panels supported on the grid runners, the grid runners being arranged in a repeating pattern with nominal center-to-center dimensions to frame a plurality of rectangular areas and the panels being configured to substantially close the rectangular areas, the grid runners having a cross-section in the general configuration of an inverted tee with a lower flange including laterally outward portions extending generally vertically upwardly, the lower flange of the grid runners being substantially identical, the panels having clip elements attached at opposite edges, each clip element having a hook interengaging the vertically upwardly extending flange portion of an adjacent runner to transfer a portion of the weight of the panel to the adjacent grid runner and to horizontally lock the panel in assembled position, each of said panels having its four edges configured to provide a lower cantilevered section underlying an adjacent grid runner to leave a relatively narrow gap between the edges of adjacent panels whereby the true width of the grid runners is concealed from view below the ceiling, the inter engagement of the clip hook with the lower flanges precisely locating the respective panel so that variations in the width of the gaps throughout the ceiling system are not readily visually detectable.

14. A ceiling system as set forth in claim 13, wherein the center-to-center distance of the grid is nominally two feet.

15. A ceiling system as set forth in claim 14, wherein the gap of the panels is nominally ⅛" when viewed from below.

16. A ceiling system as set forth in claim 13, wherein the panel edges associated with the clips are rabbeted with a contour that prevents horizontal shifting of the panel unless the panel is raised sufficiently to at least disengage its hook from the adjacent vertically upwardly extending flange portion.

* * * * *